US008833925B2

(12) United States Patent
Bradley

(10) Patent No.: US 8,833,925 B2
(45) Date of Patent: Sep. 16, 2014

(54) RADIANT DRUM DRIER FOR PRINT MEDIA IN A PRINTING SYSTEM

(71) Applicant: Timothy G. Bradley, Longmont, CO (US)

(72) Inventor: Timothy G. Bradley, Longmont, CO (US)

(73) Assignee: Ricoh Production Print Solutions LLC, Boulder, CO (US)

( * ) Notice: Subject to any disclaimer, the term of this patent is extended or adjusted under 35 U.S.C. 154(b) by 28 days.

(21) Appl. No.: 13/630,072

(22) Filed: Sep. 28, 2012

(65) Prior Publication Data

US 2014/0092183 A1 Apr. 3, 2014

(51) Int. Cl.
*B41J 2/01* (2006.01)
*B41J 11/00* (2006.01)

(52) U.S. Cl.
CPC ..... *B41J 11/0015* (2013.01); *B41J 11/002* (2013.01)
USPC ..... 347/102

(58) Field of Classification Search
USPC ..... 347/212, 102
See application file for complete search history.

(56) References Cited

U.S. PATENT DOCUMENTS

| | | | | |
|---|---|---|---|---|
| 3,449,546 | A | 6/1969 | Dhoble | |
| 4,435,069 | A * | 3/1984 | Sato | 399/336 |
| 4,435,633 | A | 3/1984 | Stryjewski | |
| 4,970,528 | A | 11/1990 | Beaufort et al. | |
| 5,504,313 | A | 4/1996 | Kako et al. | |
| 5,974,294 | A * | 10/1999 | Tange | 399/328 |
| 6,390,618 | B1 | 5/2002 | Wotton et al. | |
| 7,108,365 | B2 | 9/2006 | Sekiya | |
| 2004/0258426 | A1 | 12/2004 | Kishi et al. | |
| 2004/0264991 | A1 | 12/2004 | Yoshikawa | |
| 2011/0234723 | A1 | 9/2011 | Mandel | |

FOREIGN PATENT DOCUMENTS

| | | | | |
|---|---|---|---|---|
| JP | 01316776 | | 12/1989 | |
| JP | 2006-003694 | * | 1/2006 | G03G 15/20 |
| JP | 2006003694 | | 1/2006 | |
| JP | 2011059574 | | 3/2011 | |

OTHER PUBLICATIONS

Computer-generated translation of JP 2006-003694, published on Jan. 2006.*

* cited by examiner

*Primary Examiner* — Huan Tran
(74) *Attorney, Agent, or Firm* — Duft Bornsen & Fettig LLP

(57) ABSTRACT

Methods and systems disclosed herein provide for drying of wet colorants applied to a print media utilizing a substantially optically transparent drum that includes a radiant energy source. In one embodiment, a printer includes a hollow drum and a radiating energy source inside of the hollow drum. The energy source radiates energy for drying a wet colorant applied to a print media. The hollow drum surrounds the energy source and is substantially transparent to the radiated energy of the energy source. The drum includes a peripheral surface that contacts the print media as the print media transits along a print path. The drum conductively heats the print media for drying the wet colorant, and permits the radiated energy of the energy source to dry the wet colorant.

16 Claims, 3 Drawing Sheets

RADIANT DRUM DRIER FOR PRINT MEDIA IN A PRINTING SYSTEM

FIELD OF THE INVENTION

The invention relates to the field of printing systems, and in particular, to drying wet colorants applied to print media.

BACKGROUND

Printing systems typically include a print controller and one or more print engines. The print controller directs the overall operation of the printing system including, for example, host interfacing, interpretation or rendering of print data, and lower level process control or interface features of the print engines. The print engines transfer some type of colorant to a printable media, such as paper, under the direction of the print controller. The colorant may include wet inks, toner, waxes, etc. When the colorant is a type of wet ink, such as an aqueous ink, part of the printing process includes drying the wet ink that has been applied to the print media.

Various type of drying mechanisms exist for drying wet colorants, such as wrapping the print media around a heated metal drum, radiating the print media with Infra-Red (IR) lamps, and directing hot air across the print media. However, each of these drying mechanisms has various drawbacks. Drum dryers have relatively poor heat transfer characteristics to paper, because paper is a poor conductor of heat. This limits the speed and the weight of the print media that can be dried utilizing drum dryers. Radiant dryers have an improved heat transfer characteristic over drum dryers, but differential heating of the print media may cause the print media to wrinkle during the drying process. Although directing hot air across the print media results in a convective drying process, a boundary layer at the surface of the media may limit the drying ability without a long drying path.

SUMMARY

Embodiments described herein provide for the drying of wet colorants applied to a print media utilizing an optically transparent drum that includes a radiant energy source. When a printing system imprints a media utilizing a wet colorant, such as aqueous inks, the wet colorant is dried during the printing process. In the embodiments described, the print media imprinted with the wet colorant contacts the optically transparent drum as the media transits along the printing path. The radiant energy source and the optically transparent drum dry the wet colorant via a combination of conductive heat transfer and radiant heat transfer.

In one embodiment, a system is disclosed that includes a printer. The printer includes an energy source that is operable to radiate energy for drying a wet colorant applied to a print media. The printer further includes a hollow drum surrounding the energy source that is substantially transparent to the radiated energy of the energy source. The drum includes a peripheral surface that is operable to contact the print media. The drum is further operable to conductively heat the print media for drying the wet colorant applied to the print media, and to permit the radiated energy of the energy source to dry the wet colorant applied to the print media.

In another embodiment, a method is disclosed. The method comprises imprinting a print media utilizing a wet colorant. The method further comprises applying the print media to a peripheral surface of a hollow drum that surrounds an energy source, where the drum is substantially transparent to a radiated energy of the energy source. The method further comprises energizing the energy source for conductive heating of the print media utilizing the drum and for radiative heating of the print media utilizing the radiated energy of the energy source.

Other exemplary embodiments may be described below.

DESCRIPTION OF THE DRAWINGS

Some embodiments of the present invention are now described, by way of example only, and with reference to the accompanying drawings. The same reference number represents the same element or the same type of element on all drawings.

DESCRIPTION OF THE EMBODIMENTS

The figures and the following description illustrate specific exemplary embodiments of the invention. It will thus be appreciated that those skilled in the art will be able to devise various arrangements that, although not explicitly described or shown herein, embody the principles of the invention and are included within the scope of the invention. Furthermore, any examples described herein are intended to aid in understanding the principles of the invention, and are to be construed as being without limitation to such specifically recited examples and conditions. As a result, the invention is not limited to the specific embodiments or examples described below, but by the claims and their equivalents.

Figure 1:
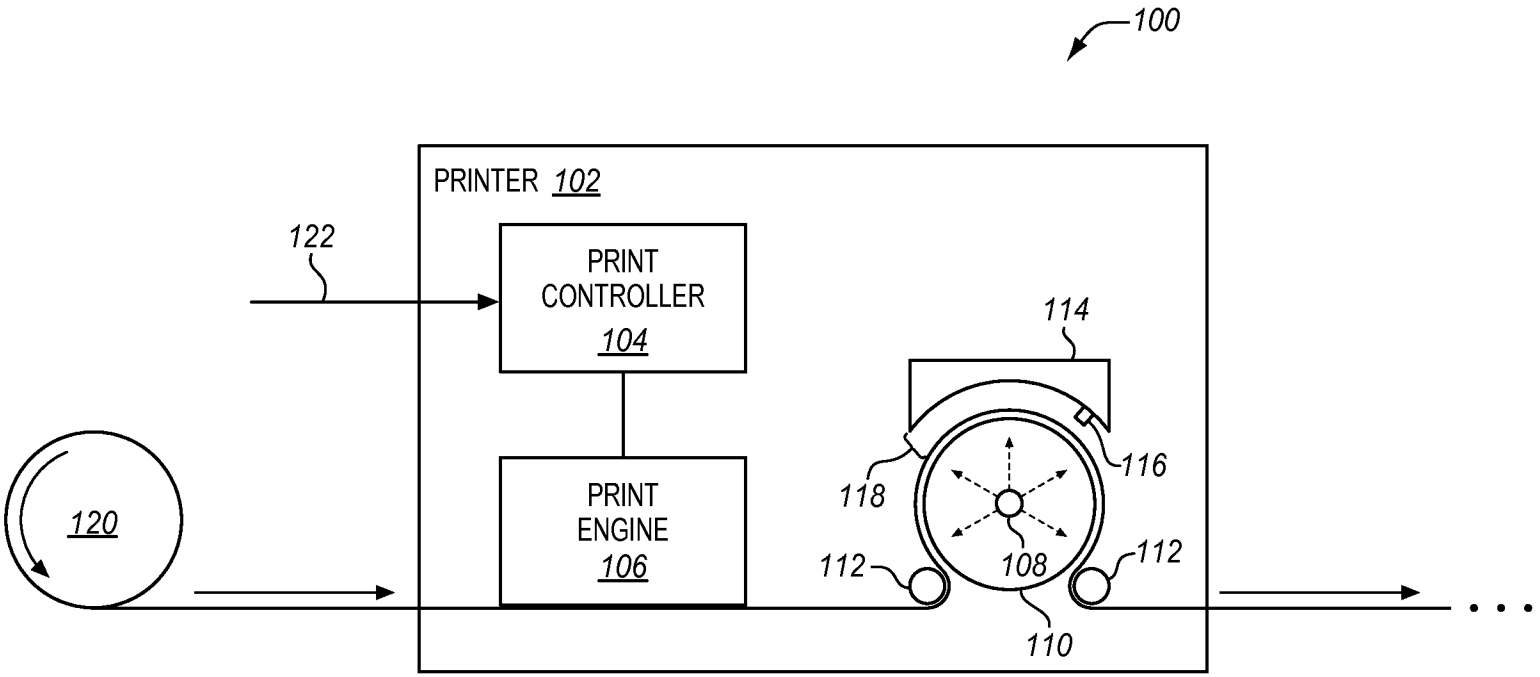
FIG. 1 is a block diagram of a system that includes a printer in an exemplary embodiment.

FIG. 1 is a block diagram of a system 100 that includes a printer 102 in an exemplary embodiment. In this embodiment, printer 102 includes a print controller 104, a print engine 106, a hollow drum 110, and an energy source 108 inside of hollow drum 110. Printer 102 may also include one or more turn rollers 112 to direct a continuous form media 120 to contact drum 110 along a print path. However, other embodiments may utilize cut sheet media. Therefore, the embodiments described herein are not merely limited to continuous form media. Further, although a particular print path of media 120 through printer 102 is illustrated in FIG. 1, one skilled in the art will recognize that other print paths may exist and therefore, the specific print path illustrated in FIG. 1 is not intended to limit the scope of the claims.

Generally, print controller 104 of printer 102 receives print data 122 from a host system (not shown) for imprinting onto media 120. Print data 122 may include raw print data in a Page Description Language (PDL), Printer Control Language (PCL), PostScript Data, Intelligent Printer Data Stream (IPDS) data format, etc. Print data 122 may also be included as part of a print job for printer 102. Print jobs may include a job ticket that specifies various characteristics of the job, such as the number of logical pages per sheet side, the media size, etc. Print data 122 received by print controller 104 is rasterized into bitmap data and provided to print engine 106. Print engine 106 marks media 120 based on the bitmap data to generate a printed output. In this embodiment, print engine 106 marks media 120 utilizing a type of wet colorant. One example of a wet colorant is aqueous inks. Aqueous inks are water-based inks and therefore, part of the printing process includes drying the ink that is applied to media 120.

During operation of printing system 100, media 120 unrolls in the direction indicated by the arrow illustrated for media 120. Media 120 travels proximate to print engine 106 for a marking process. Although only one print engine 106 is shown in FIG. 1, printer 102 may include a number of print engines. For example, printer 102 may include one or more print engines on each side of media 120.

After print engine 106 marks media 120 with the wet colorant, media 120 is directed by one or more turn rollers 112 to contact drum 110 for drying the wet colorant applied to media 120. Media 120 partially wraps around drum 110 and exits printer 102 in the direction indicated by the arrow located to the right of printer 102. In this embodiment, media 120 is marked with a wet colorant applied to a surface of media 120 that is away from drum 110, although one skilled in the art will recognize that the wet colorant may be applied to the opposite side of media 120 such that the wet colorant contacts drum 110.

As discussed previously, wet colorants applied to media 120 are dried during the printing process. However, various problems are associated with the different processes of drying wet colorants. Conductive drying of a print media utilizing a solid metal drum may have poor heat transfer characteristics because print media, such as paper, is a poor conductor of heat. For radiative drying, the print media typically travels along a straight path under a number of radiative sources. The radiative sources heat the wet colorant and/or the print media to facilitate drying through evaporation. Problems with radiative drying may arise when the media is heated non-uniformly. This may cause shrinkage and warping of the media. Another drying method for drying wet colorants is hot air. Although directing hot air across the print media results in a convective drying process, a boundary layer at the surface of the media may limit the drying ability without a long drying path.

Printer 102 of FIG. 1 dries wet colorants by utilizing drum 110 which surrounds energy source 108 and is substantially transparent to the radiated energy of energy source 108. Energy source 108 includes any component, system, or device that is operable to radiate energy for drying the wet colorant applied to media 120. One example of energy source 108 is an Infra-Red (IR) energy source. Although only one energy source 108 is illustrated in FIG. 1, drum 110 may include any number of radiating energy sources as a matter of design choice. Drum 110 illustrated in FIG. 1 includes any component, system, or device that is operable to permit the radiated energy of energy source 108 to radiate media 120 and/or the wet colorant applied to media 120.

As media 120 wraps around drum 110, drum 110 conductively dries the wet colorant applied to media 120 (which may be due to drum 110 undergoing a heating process by partially absorbing some of the radiated energy of energy source 108). Further, because drum 110 is substantially transparent to the radiated energy of energy source 108, media 120 and/or the wet colorant applied to media 120 is exposed to the radiated energy of energy source 108. In other words, drum 110 permits the radiated energy of energy source 108 to impinge upon media 120 and/or the wet colorant. The impingement of the radiated energy of energy source 108 upon the wet colorant may occur regardless of whether the wet colorant is applied to the surface of media 120 that is in direct contact with drum 110 or the surface of media 120 that is away from drum 110. For instance, media 120 may be partially transparent to the frequencies of the radiated energy of energy source 108. Thus, the radiated energy of energy source 108 may pass through media 120 and be absorbed by the wet colorant even though the wet colorant may be applied to the side of media 120 that is not in direct contact with drum 110. Regardless of which surface of media 120 the wet colorant is applied to, the substantially transparent drum 110 along with energy source 110 provides advantages for drying wet colorants over other drying processes previously described by providing both a conductive heating component and a radiated heating component to print media 120 and/or the wet colorants that are applied to print media 120.

In some embodiments, printer 102 may include a reflector 114 that is proximate to drum 110. Reflector 114 includes any component, system, or device that is operable to reflect a portion of the radiated energy of energy source 108 back towards media 120. As discussed, media 120 may be partially transparent to the radiated energy of energy source 108. Thus, a portion of the radiated energy may pass through media 120 (and/or the wet colorant) and therefore, would escape from the region around drum 110. Reflector 114 operates to reflect some portion of the radiated energy that passes through media 120 back towards media 120. This also improves the drying process for printer 102 by increasing the amount of radiated energy proximate to the surfaces of media 120.

In embodiments whereby reflector 114 is present in printer 102, an air gap 118 is formed between the outside surface of drum 110 (also referred to herein as the peripheral surface of drum 110) and reflector 114. In some embodiments, a sensor 116 may be included between reflector 114 and drum 110. Sensor 116 may measure the temperature within air gap 118, may measure the IR absorption of water vapor present within air gap 118, etc., to determine the drying state of the wet colorant. During the drying process for water-based inks, the water evaporates and forms water vapor within air gap 118. Water vapor absorbs IR energy, so a difference between an expected IR output of energy source 108 as measured at sensor 116 and an actual IR output of energy source 108 as measured at sensor 116 may allow for a determination of the amount of water vapor present in air gap 118. Using information about the drying state of the wet colorant, printer 102 may then adjust the power output of energy source 108. For example, if printer 102 determines that the wet colorant is not sufficiently dry after applying media 120 to drum 110, then printer 102 may increase the power output of energy source 108 to facilitate an increase in the drying performance of printer 102. Further, printer 102 may vary the rate at which media 120 transits across drum 110 to modify the drying performance of printer 102. The particulars of how printer 102 may operate to dry wet colorants will become readily apparent in the following discussion for FIG. 2.

Figure 2:
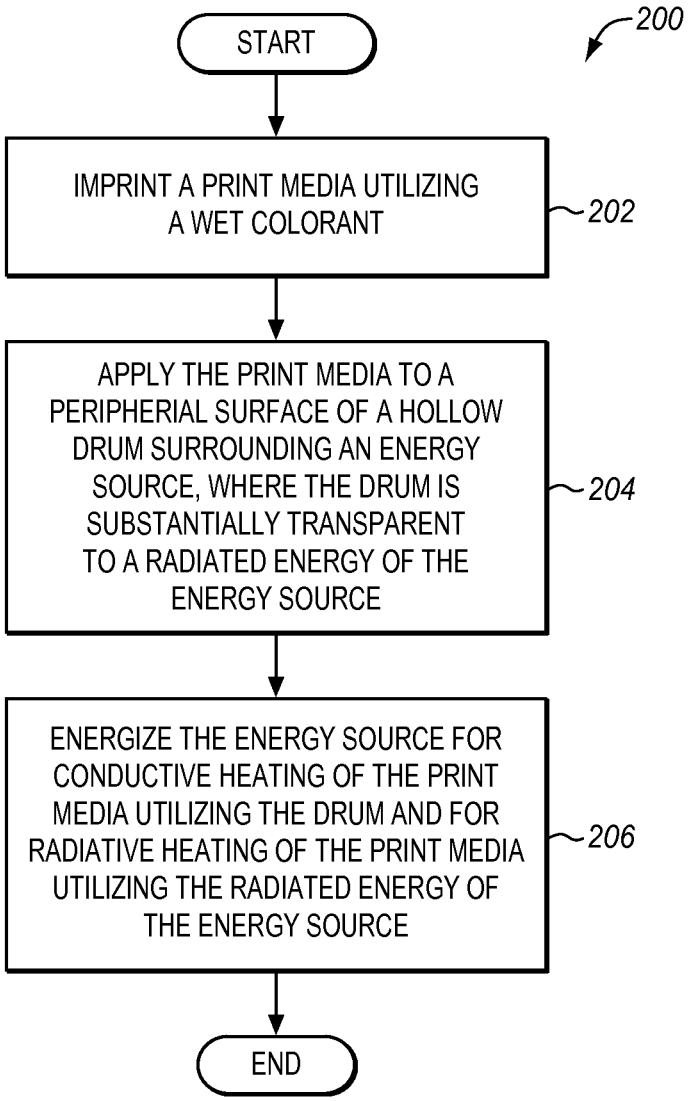
FIG. 2 is flow chart illustrating a method of drying wet colorants applied to a print media utilizing a substantially optically transparent drum that includes a radiant energy source in an exemplary embodiment.

FIG. 2 is flow chart illustrating a method 200 of drying wet colorants applied to a print media utilizing a substantially optically transparent drum that includes a radiant energy source in an exemplary embodiment. The steps of method 200 will be described with respect to system 100 of FIG. 1, although one skilled in the art will understand that method 200 may be performed by other systems not shown. The steps of method 200 described herein are not all inclusive and may include other steps not shown. The steps may also be performed in an alternative order.

In step 202, print engine 106 imprints media 120 utilizing a wet colorant. One example of a wet colorant is an aqueous based ink. To imprint media 120, print engine 106 may utilize a number of individual nozzles to eject droplets of the wet colorant onto media 120.

In step 204, print media 120 is applied to a peripheral surface of drum 110. In particular, turn rollers 112 adjust the path of media 120 such that media 120 enters an area around drum 110, contacts the peripheral surface of drum 110, wraps around drum 110, and exits printer 102. As discussed previously, drum 110 is substantially transparent to the radiated energy of energy source 108. For example, energy source 108 may be an IR source. Drum 110 may be formed from a ceramic material that is optically transparent to the IR energy. For instance, drum 110 may be optically transparent to a frequency spectrum of between about 100 nanometers and 6000 nanometers.

In step 206, energy source 108 is energized. Energizing energy source 108 conductively heats media 120 for drying of the wet colorant applied to media 120 utilizing drum 110. Because drum 110 is not completely transparent to the radiated energy of energy source 108, drum 110 absorbs some of the radiated energy generated by energy source 108, and heats media 120 via conductive heat transfer. In this embodiment, media 120 is in contact with drum 110. This allows for conductive heat transfer between drum 110 and media 120. Energizing energy source 108 also provides the radiated energy of energy source 108 to dry the wet colorant applied to media 120 because drum 110 is substantially transparent to the radiated energy of energy source 108. Media 120 and/or the wet colorant may absorb the radiated energy during the drying process. For example, media 120 may absorb a portion of the radiated energy and therefore, heat up. This in turn heats the wet colorant applied to media 120. Further, the radiated energy may be absorbed by the wet colorant, causing the wet colorant to heat up. In cases whereby the wet colorant is a water-based colorant, water vapor may be formed during the drying process, which may disperse around drum 110 within air gap 118. This may allow for a determination of the drying state of the wet colorant applied to media 120.

The use of a substantially optically transparent drum 110 in addition to energy source 108 inside of drum 110 provides a drying mechanism that includes both conductive drying and radiative drying of the wet colorants applied to media 120. This combination of drying mechanisms has advantages over the drying mechanisms previously described. For instance, drum 110 acts to prevent media 120 from shrinking irregularly, which may cause quality problems in a printed output. Further, although media 120 may be a poor conductor of heat, the addition of energy source 108 and the radiant energy that drum 110 permits energy source 108 to provide to media 120 during the drying process substantially improves the drying performance of printer 102 when wet colorants are used to mark media 120.

Figure 3:
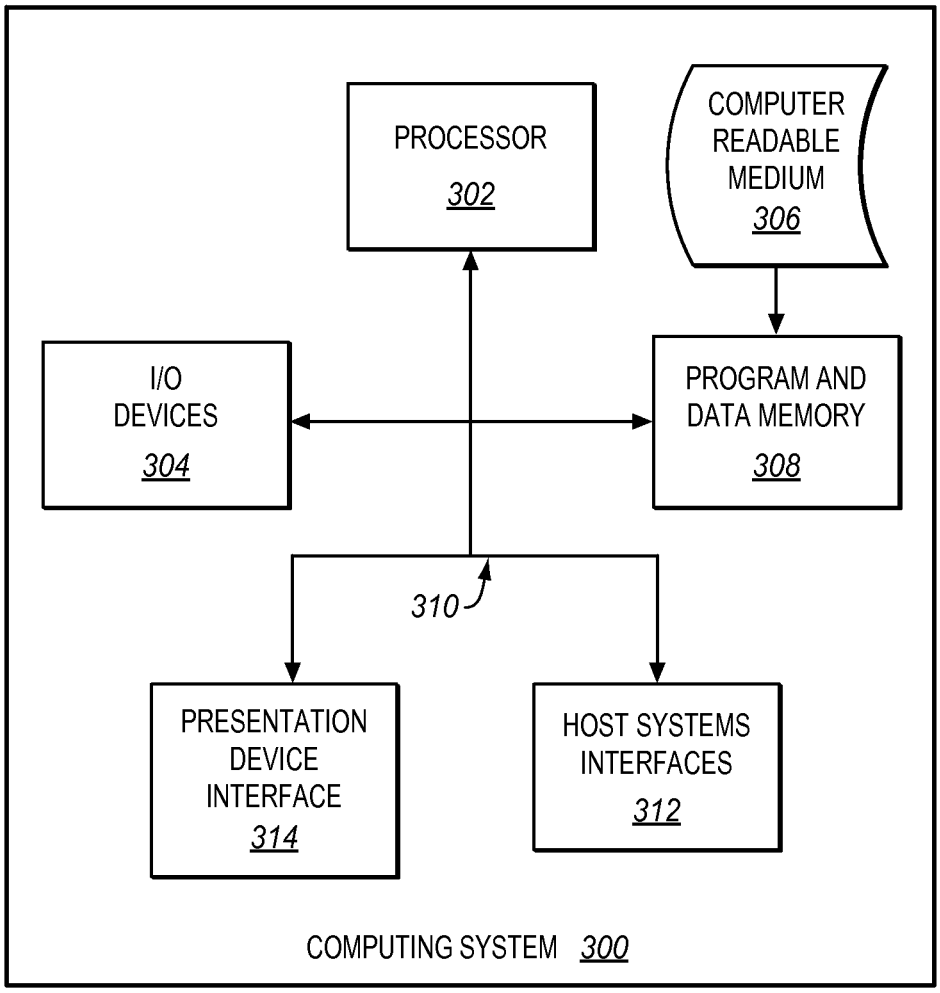
FIG. 3 illustrates a computing system in which a computer readable medium provides instructions for performing the method of FIG. 2 in an exemplary embodiment.

The invention can take the form of an entirely hardware embodiment, an entirely software embodiment or an embodiment containing both hardware and software elements. In one embodiment, the invention is implemented in software, which includes but is not limited to firmware, resident software, microcode, etc. FIG. 3 illustrates a computing system 300 in which a computer readable medium may provide instructions for performing the method of FIG. 2 in an exemplary embodiment.

Furthermore, the invention can take the form of a computer program product accessible from a computer-usable or computer-readable medium 306 providing program code for use by or in connection with a computer or any instruction execution system. For the purposes of this description, a computer-usable or computer readable medium 306 can be any apparatus that can tangibly store the program for use by or in connection with the instruction execution system, apparatus, or device.

The medium 306 can be any tangible electronic, magnetic, optical, electromagnetic, infrared, or semiconductor system (or apparatus or device). Examples of a computer-readable medium 306 include a semiconductor or solid state memory, magnetic tape, a removable computer diskette, a random access memory (RAM), a read-only memory (ROM), a rigid magnetic disk and an optical disk. Current examples of optical disks include compact disk-read only memory (CD-ROM), compact disk-read/write (CD-R/W) and DVD.

A data processing system suitable for storing and/or executing program code will include one or more processors 302 coupled directly or indirectly to memory 308 through a system bus 310. The memory 308 can include local memory employed during actual execution of the program code, bulk storage, and cache memories which provide temporary storage of at least some program code in order to reduce the number of times code is retrieved from bulk storage during execution.

Input/output or I/O devices 304 (including but not limited to keyboards, displays, pointing devices, etc.) can be coupled to the system either directly or through intervening I/O controllers.

Network adapters may also be coupled to the system to enable the data processing system to become coupled to other data processing systems, such a through host systems interfaces 312, or remote printers or storage devices through intervening private or public networks. Modems, cable modem and Ethernet cards are just a few of the currently available types of network adapters. Computer system 300 further includes a presentation device interface 314.

Although specific embodiments were described herein, the scope of the invention is not limited to those specific embodiments. The scope of the invention is defined by the following claims and any equivalents thereof.

I claim:

1. A system comprising:

a printer including:

an energy source operable to radiate energy for drying a wet colorant applied to a print media;

a hollow drum surrounding the energy source and substantially transparent to the radiated energy of the energy source, wherein the drum includes a peripheral surface operable to contact the print media;

a reflector disposed proximate to the peripheral surface of the drum and operable to reflect a portion of the radiated energy of the energy source back towards the print media, wherein an air gap is formed between the peripheral surface of the drum and the reflector to facilitate evaporative drying of the wet colorant applied to the print media; and a sensor disposed between the peripheral surface of the drum and the reflector;

the drum further operable to conductively heat the print media for drying the wet colorant applied to the print media, and to permit the radiated energy of the energy source to dry the wet colorant applied to the print media;

the sensor operable to measure at least one of a temperature within the air gap and an Infra-Red (IR) absorption of water vapor within the air gap for determining a drying state of the wet colorant applied to the print media.

2. The system of claim 1 wherein:

the printer further includes:

a control system operable to receive measured data from the sensor, to determine the drying state of the wet colorant applied to the print media based on the measured data, and to modify an energy output of the energy source based on the drying state of the wet colorant.

3. The system of claim 1 wherein:

the drum is formed from an optically transparent ceramic.

4. The system of claim 3 wherein:

the energy source is an Infra-Red (IR) energy source; and the ceramic drum is optically transparent between a frequency range of about 100 nanometers and 6000 nanometers.

5. A method comprising:

imprinting a print media utilizing a wet colorant;

applying the print media to a peripheral surface of a hollow drum surrounding an energy source, wherein the drum is substantially transparent to a radiated energy of the energy source; and energizing the energy source for conductive heating of the print media utilizing the drum and for radiative heating of the print media utilizing the radiated energy of the energy source.

6. The method of claim 5 further comprising:

reflecting a portion of the radiated energy of the energy source back towards the print media utilizing a reflector, wherein an air gap is formed between the peripheral surface of the drum and the reflector to facilitate evaporative drying of the wet colorant applied to the print media.

7. The method of claim 6 further comprising:

measuring at least one of a temperature within the air gap and an Infra-Red (IR) absorption of water vapor within the air gap for determining a drying state of the wet colorant applied to the print media.

8. The method of claim 7 further comprising:

determining the drying state of the wet colorant applied to the print media based on the at least one of the temperature and the IR absorption of water vapor; and modifying an energy output of the energy source based on the drying state of the wet colorant.

9. The method of claim 5 wherein:

the drum is formed from an optically transparent ceramic.

10. The method of claim 9 wherein:

the energy source is an Infra-Red (IR) energy source; and the ceramic drum is optically transparent between a frequency range of about 100 nanometers and 6000 nanometers.

11. A non-transitory computer readable medium embodying programmed instructions which, when executed by a processor of a printing system, direct the processor to:

imprint a print media utilizing a wet colorant;

apply the print media to a peripheral surface of a hollow drum surrounding an energy source, wherein the drum is substantially transparent to a radiated energy of the energy source; and energize the energy source for conductive heating of the print media utilizing the drum and for radiative heating of the print media utilizing the radiated energy of the energy source.

12. The non-transitory computer readable medium of claim 11 wherein the instructions further direct the processor to:

reflect a portion of the radiated energy of the energy source back towards the print media utilizing a reflector, wherein an air gap is formed between the peripheral surface of the drum and the reflector to facilitate evaporative drying of the wet colorant applied to the print media.

13. The non-transitory computer readable medium of claim 12 wherein the instructions further direct the processor to:

measure at least one of a temperature within the air gap and an Infra-Red (IR) absorption of water vapor within the air gap for determining a drying state of the wet colorant applied to the print media.

14. The non-transitory computer readable medium of claim 13 wherein the instructions further direct the processor to:

determine the drying state of the wet colorant applied to the print media based on the at least one of the temperature and the IR absorption of water vapor; and modify an energy output of the energy source based on the drying state of the wet colorant.

15. The non-transitory computer readable medium of claim 11 wherein:

the drum is formed from an optically transparent ceramic.

16. The non-transitory computer readable medium of claim 15 wherein:

the energy source is an Infra-Red (IR) energy source; and the ceramic drum is optically transparent between a frequency range of about 100 nanometers and 6000 nanometers.

* * * * *